US010156103B2

(12) United States Patent
Kirk et al.

(10) Patent No.: US 10,156,103 B2
(45) Date of Patent: Dec. 18, 2018

(54) CENTRALISER

(71) Applicant: Downhole Products Limited, Aberdeen (GB)

(72) Inventors: Andrew Kirk, Methlick (GB); Nathan James Kirk, Methlick (GB)

(73) Assignee: DOWNHOLE PRODUCTS LIMITED, Aberdeen (GB)

( * ) Notice: Subject to any disclaimer, the term of this patent is extended or adjusted under 35 U.S.C. 154(b) by 174 days.

(21) Appl. No.: 15/119,199

(22) PCT Filed: Feb. 13, 2015

(86) PCT No.: PCT/GB2015/050416
§ 371 (c)(1),
(2) Date: Aug. 16, 2016

(87) PCT Pub. No.: WO2015/140494
PCT Pub. Date: Sep. 24, 2015

(65) Prior Publication Data

US 2017/0051563 A1 Feb. 23, 2017

(30) Foreign Application Priority Data

Mar. 20, 2014 (GB) ..... 1405011.6

(51) Int. Cl.
*E21B 17/10* (2006.01)

(52) U.S. Cl.
CPC ..... *E21B 17/1078* (2013.01); *E21B 17/10* (2013.01); *E21B 17/1028* (2013.01)

(58) Field of Classification Search
CPC ... E21B 17/1078; E21B 17/1028; E21B 17/10
See application file for complete search history.

(56) References Cited

U.S. PATENT DOCUMENTS 3,575,239 A 4/1971 Solum
5,797,455 A 8/1998 Barron et al.
(Continued)

FOREIGN PATENT DOCUMENTS

CN 2119492 U 10/1992
CN 1522335 A 8/2004
CN 1526049 A 9/2004
(Continued)

OTHER PUBLICATIONS

Wehland, Florian, "International Search Report," prepared for PCT/GB2015/050416, dated Jul. 2, 2015, three pages.
(Continued)

*Primary Examiner* — Brad Harcourt

(57) ABSTRACT

A centralizer comprises two collars that are connected by asymmetric spring bows. The spring bows each comprise two arcs, where the curvature of one arc is inverted with respect to the curvature of the other arc, one being concave and the other convex. The spring bows are in sets that are equidistantly spaced around the circumference of the collars, each set having the same configuration, and the opposite configuration to the spring bows in the other set. Upon insertion into a wellbore, one set of spring bows is therefore compressed before the other set. Upon compression, the deformation of the concave arc leads to mutual deformation of the convex arc, and the spring bows adopt a flatter configuration, enhancing the rotational freedom of the tubular.

30 Claims, 6 Drawing Sheets

(56) References Cited

U.S. PATENT DOCUMENTS

| | | | |
|---|---|---|---|
| 6,997,254 | B2 | 2/2006 | Jenner |
| 2011/0030973 | A1 | 2/2011 | Jenner |

FOREIGN PATENT DOCUMENTS

| | | | |
|---|---|---|---|
| DE | 1169387 | B | 5/1964 |
| DE | 3508086 | C1 | 8/1986 |
| DE | 102005040482 | A1 | 3/2007 |
| EP | 0196339 | A1 | 10/1986 |
| GB | 689807 | A | 4/1953 |
| RU | 2274744 | C1 | 4/2006 |
| RU | 2 430 234 | | 9/2011 |
| RU | 2 430 235 | | 9/2011 |
| WO | WO-2003002842 | A1 | 1/2003 |
| WO | WO-2011018617 | A1 | 2/2011 |
| WO | WO-2012095671 | A2 | 7/2012 |

OTHER PUBLICATIONS

Submission of third party observations on international publication No. WO 2015/140494 A1; 24 pages; May 31, 2016.
PCT Third Party Observation on PCT application No. PCT/GB2015/050416; submitted by Rosemary Jackson; 5 pages; Jun. 2, 2016.
Statement on the validity of UK patent No. 2524311; 26 pages.
Observations in reply on UK patent No. 2524311; 15 pages.

CENTRALISER

The present application relates to a centraliser, particularly for use in centralising an elongate member in a bore of an oil or gas well.

BACKGROUND TO THE INVENTION

Centralisers are well known in the field of oil and gas drilling and production. Centralisers are used to maintain a minimum stand-off or radial distance between the inner surface of a bore of a well, and a device being deployed (usually a tubular or string of tubulars) within the bore. Often, the bore can be lined, for example, with tubular casing or liner, and the string of tubulars is centralised within the bore of the casing or liner, but centralisers can also be used in un-lined bores.

The function of the centraliser is to maintain a consistent radial spacing or stand-off between the outer surface of the device in the bore and the inner surface of the bore, so that the annulus between the device and the bore has a generally consistent radial dimension. This is desirable for a number of reasons. In certain operations in which centralisers are used, for example in completion operations, the annulus between a tubular string and the inner surface of the bore is filled with cement, and it is desirable that the layer of cement surrounding the tubular has a generally consistent radial dimension along the length of the tubular. Therefore, centralisers are deployed between the outer surface of the tubular and the inner surface of the bore at intervals along the tubular in order to maintain the stand-off so that the layer of cement formed in the annulus has a generally consistent radial depth along the length of the tubular.

Centralisers can be of the solid body type, being cast or otherwise formed in a single piece. An example of this type of centraliser is described in our earlier granted patent U.S. Pat. No. 5,797,455, the disclosure of which is incorporated herein by reference. Centralisers can also be of the spring bow type, having end collars with resilient strips of metal extending radially outwards in the form of bows between the collars. The bows are compressed and resiliently energised when the centraliser is inserted into the bore, and are designed to remain in compression when in the bore to hold the tubular in or near to the centre of the bore. Examples of this type are described in EP0196339, CN2119492 and in US2011/0030973, the disclosures of which are incorporated herein by reference, and which are useful for understanding the invention.

SUMMARY OF THE INVENTION

According to the present invention, there is provided a centraliser having a central axis, and having first and second axially spaced collars and at least one resilient device extending between the collars, the resilient device comprising a first arc and a second arc, and wherein the curvature of the second arc is different from the curvature of the first arc.

Optionally, the curvature of the second arc is inverted with respect to the curvature of the first arc.

Optionally the first arc is convex (curving outward in relation to the axis of the centraliser) and the second arc is concave (curving inward in relation to the axis of the centraliser).

Optionally a first portion of the resilient device is set in the first arc, and a second portion of the resilient device is set in the second arc.

The first (convex) arc and optionally the second (concave) arc are optionally each spaced radially outwardly from the collars.

The first arc is optionally connected to the second arc at a location spaced axially between the first and second collars. Optionally the first arc transitions into the second arc at a transition point. In certain examples, the transition point between the first and second arcs can be approximately at the midpoint between the first and second collars. Alternatively, the transition point between the first and second arcs can be closer to one of the collars than to the other.

Optionally, the resilient device is asymmetric. Optionally the first (convex) arc has an apex which is spaced radially away from the axis of the centraliser, and which optionally defines the local maximum or maximum distance between the first arc and the axis of the centraliser at the resting configuration. Optionally the second (concave) arc has an apex which is radially spaced between the apex of the first arc and the axis of the centraliser. Optionally the apex of the second arc is axially spaced from the apex of the first arc. Thus the second arc is optionally axially offset in relation to the first arc.

Optionally the first arc extends into the second arc by reversing the curvature between the first and second arcs.

Optionally, the axial length of the first arc is approximately equal to the axial length of the second arc, and the transition between the first and second arcs is approximately midway between the collars. However, in certain examples, the axial length of the first arc can be different from that of the second arc, and the transition between the first and second arcs can be closer to one of the collars than to the other.

Optionally, the first and second arcs are inverted in the resting configuration of the resilient device, in the absence of forces urging it into a different configuration. Accordingly, in the resting configuration, the apex of the first arc (and thus the apex of the resilient device as a whole) is advantageously closer to one collar than to the other.

Optionally more than one resilient device is provided on the centraliser. Optionally, resilient devices are provided in sets, for example sets of two, spaced around the circumference of the collars, optionally equidistantly. For example, in certain examples, a first pair of resilient devices can be spaced at 180° spacing around the circumference of the collars. In certain other examples a set of three resilient devices can be spaced at 120° intervals around the circumference of the collars. Similar arrangements are possible with different numbers in each set, for example 4/set, spaced at 90° intervals.

Optionally the centralisers in each set have the same configuration, with the first arc closer to one of the collars, and the second arc closer to the other of the collars. Optionally at least two resilient devices (optionally in the same set) have apexes at the same axial position on the centraliser.

Optionally the resilient devices alternate around the circumference of the collars between the sets, so that the apex of any resilient device is axially spaced from the apex of each of its immediate neighbours.

Optionally not all of the resilient devices on the centraliser have the same configuration, and the apex on at least one and optionally at least two of the resilient devices can be axially staggered in relation to the apex of other resilient devices. For example, the apex on one resilient device can be closer to the first collar than to the second, but the apex on another resilient device can be closer to the second collars than to the first.

The body advantageously has a bore adapted to receive a tubular, and the body is typically adapted to be received in the bore of a larger tubular, for example a wellbore, which may be lined with casing or liner. In certain embodiments, the bore of the body is adapted to receive tubular in the form of casing, and is adapted to centralise the casing in the wellbore, which can be unlined or lined with larger bore casing or liner.

Optionally, the apex on different resilient devices is arranged to enter the bore of the well, for example the casing or liner, at a different point on the axis of the centraliser. This is advantageous, because not all of the resilient devices need to be compressed at the same time as the tubular being centralised is inserted into the bore of the casing or liner, which reduces the axial force required to feed the tubular into the bore of the casing.

Optionally, when the resilient devices are radially compressed by the insertion of the centraliser into the bore of the casing, the first and second arcs deform so that the first convex arc deforms radially inward towards the axis of the centraliser, and the second concave arc deforms radially outward, away from the axis of the centraliser. The deformation of the first arc advantageously deforms the second arc to which it is connected. The movement of the first arc during deformation upon entry to the casing advantageously moves the end of the first arc closest to the second arc thereby applying a force to the second arc to deform it. In the deformed configuration caused by radially inward urging of the apex of the resilient device, the first and second arcs cancel one another out to a certain extent by moving in radially opposing directions towards one another, and the resilient device as a whole adopts a generally flatter configuration than in the resting configuration. Optionally, in the deformed configuration, the resilient device is still biased radially away from the outer surface of the tubular being centralised, which is optionally only engaged by the inner surfaces of the end collars. Optionally in the deformed configuration, the resilient device is still spaced radially outward from the collars.

This is advantageous, because it enhances the freedom of the tubular being centralised to be rotated within the centraliser. Optionally, the inner surfaces of the end collars engaging the outer surface of the tubular being centralised can be polished and smooth, and can present a relatively low friction surface, which enhances freedom of movement of the tubular within the bore of the collars. The outer surfaces of the resilient devices which are pressed against the inner surface of the casing in the deformed configuration optionally resist rotational movement of the centraliser relative to the casing, and so the inner string being centralised within the bore of the centraliser can optionally be freely rotated during insertion of the string into the casing, while the centraliser remains rotationally static relative to the outer casing. In addition to lowering the torque experienced by the inner tubular being centralised, this example has the additional benefit that the outer surface of the tubular being centralised is only engaged by the smooth inner bearing surface of the collars, which do not damage the outer surface of the tubular, and are not damaged themselves, by rotation of the tubular within the centraliser. Keeping the resilient device biased radially away from the tubular being centralised in the deformed configuration also reduces wear on the resilient devices and on the outer surface of the tubular being centralised due to contact between the two components during rotation of the tubular relative to the centraliser.

The invention also provides a centraliser assembly incorporating a tubular, a centraliser having a bore adapted to receive the tubular, the bore having a central axis, and the centraliser having first and second axially spaced collars spaced apart on the tubular, and at least one resilient device extending between the collars, the resilient device comprising a first arc and a second arc, and wherein the curvature of the second arc is different from the curvature of the first arc.

Optionally, as the tubular and centraliser are inserted into a wellbore, the first and second arc deform to reduce the radius of curvature on each of the first and second arcs, optionally without engaging the tubular.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one example or aspect can optionally be combined alone or together with other features in different examples or aspects of the invention.

Various examples and aspects of the invention will now be described in detail with reference to the accompanying figures. Still other aspects, features, and advantages of the present invention are readily apparent from the entire description thereof, including the figures, which illustrate a number of exemplary aspects and implementations. The invention is also capable of other and different aspects and implementations, and its several details can be modified in various respects, all without departing from the present invention. Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or is preceding the recitation of the composition, element or group of elements and vice versa.

All numerical values in this disclosure are understood as being modified by "about". All singular forms of elements, or any other components described herein are understood to include plural forms thereof and vice versa. References to positional descriptions such as upper and lower and directions such as "up", "down" etc. in relation to the well are to be interpreted by a skilled reader in the context of the examples described and are not to be interpreted as limiting the invention to the literal interpretation of the term, but instead should be as understood by the skilled addressee, particularly noting that "up" with reference to a well refers to a direction towards the surface, and "down" refers to a direction deeper into the well, and includes the typical situation where a rig is above a wellhead, and the well extends down from the wellhead into the formation, but also horizontal wells where the formation may not necessarily be below the wellhead.

DESCRIPTION OF CERTAIN EXAMPLES OF THE INVENTION

Figure 1:
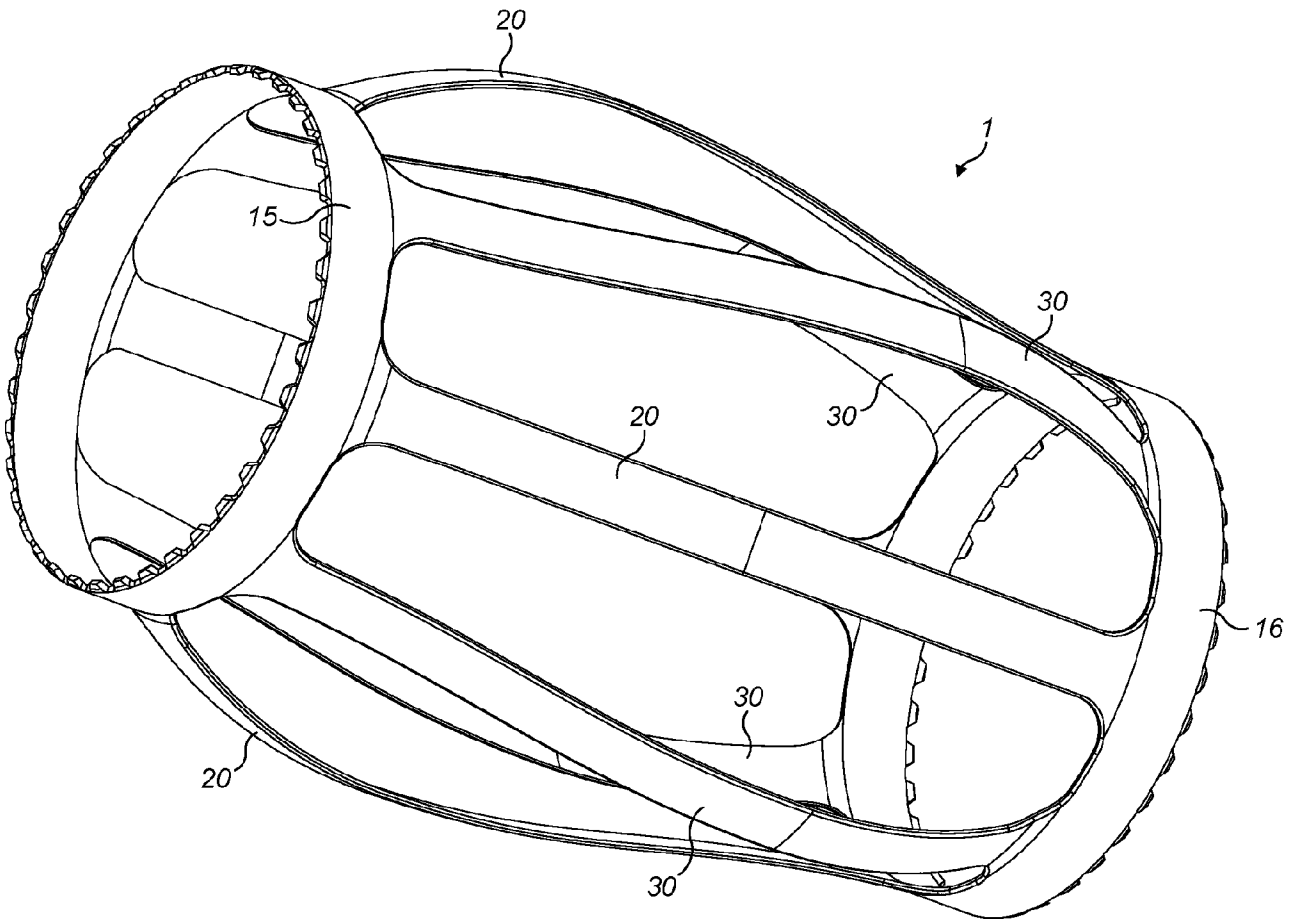
FIG. 1 shows a perspective view of a centraliser.
Figure 2:
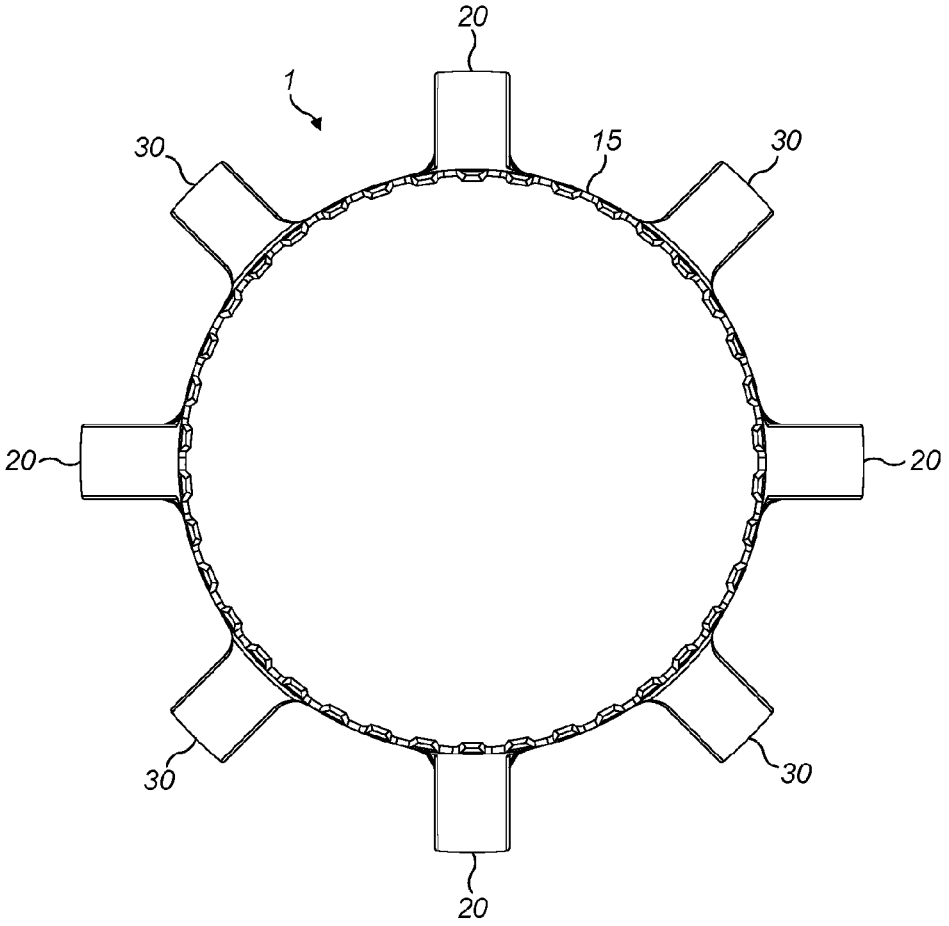
FIG. 2 shows an end view from above of the FIG. 1 centraliser.
Figure 3:
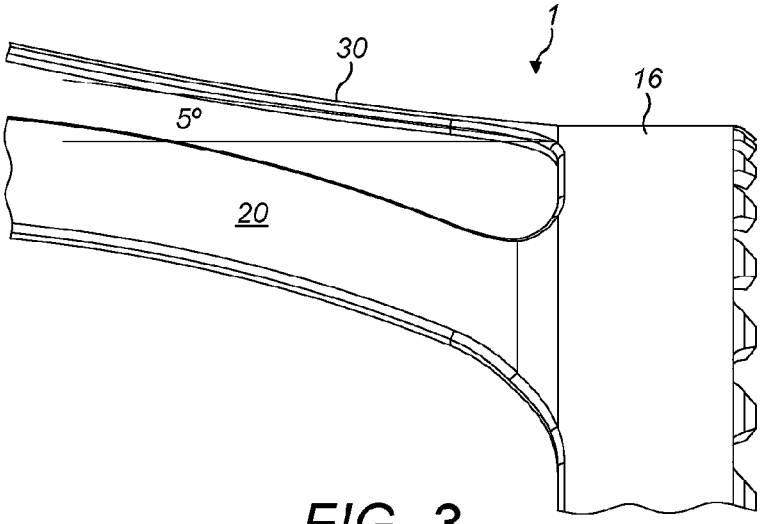
FIG. 3 shows a close-up view of a portion of an end collar of the FIG. 1 centraliser.
Figure 4:
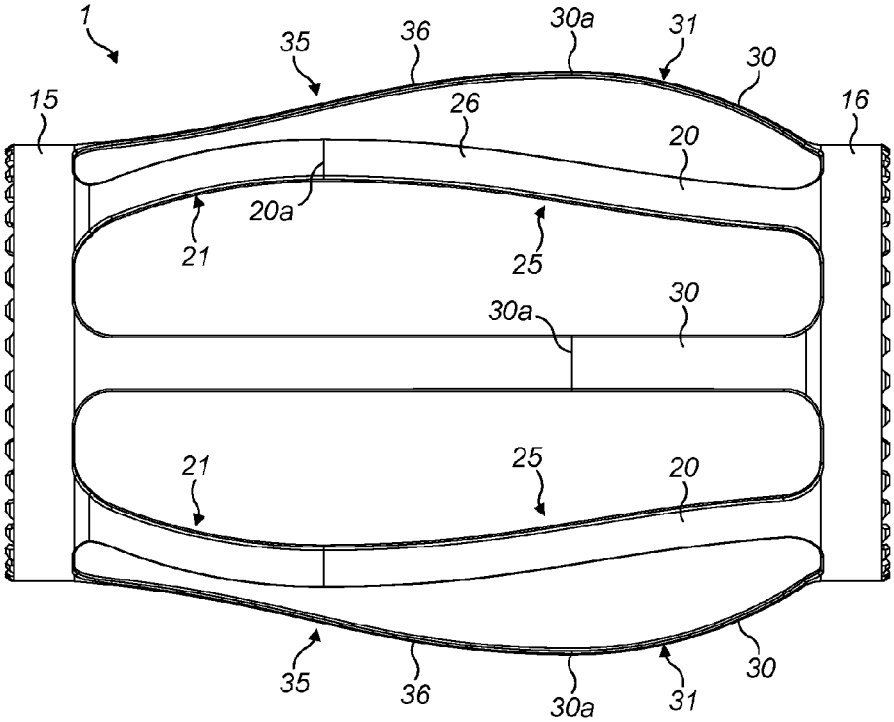
FIGS. 4, 5, 6 and 7 show sequential views of the FIG. 1 centraliser from the side, and being rotated through sequential positions in each view.
Figure 5:
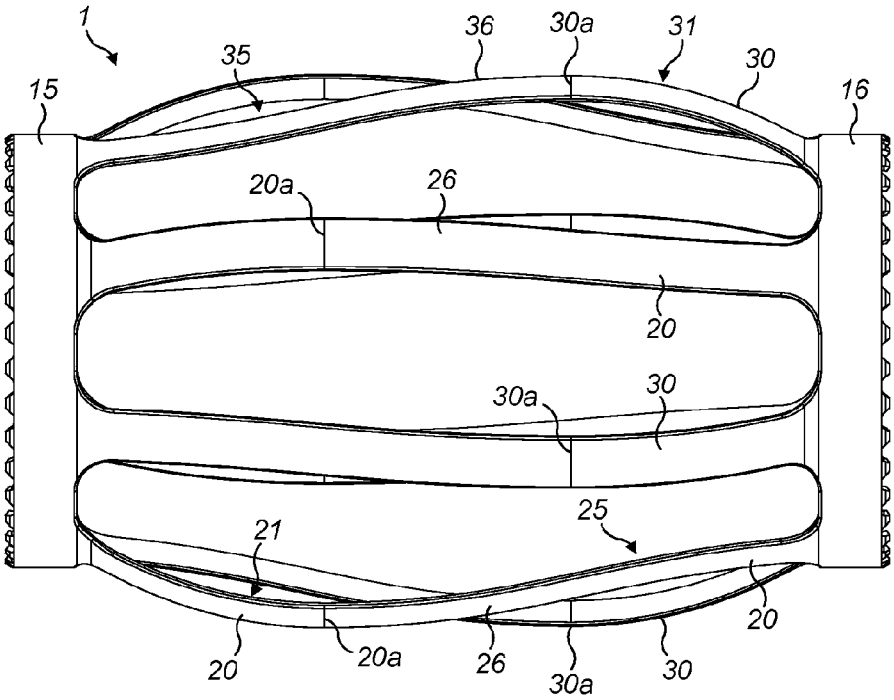
Figure 6:
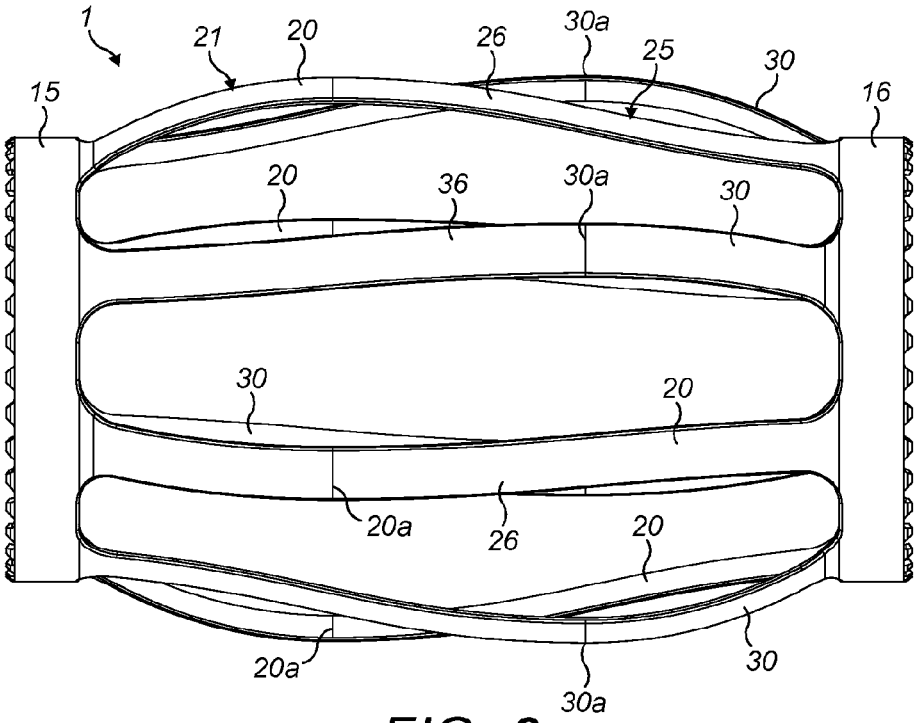
Figure 7:
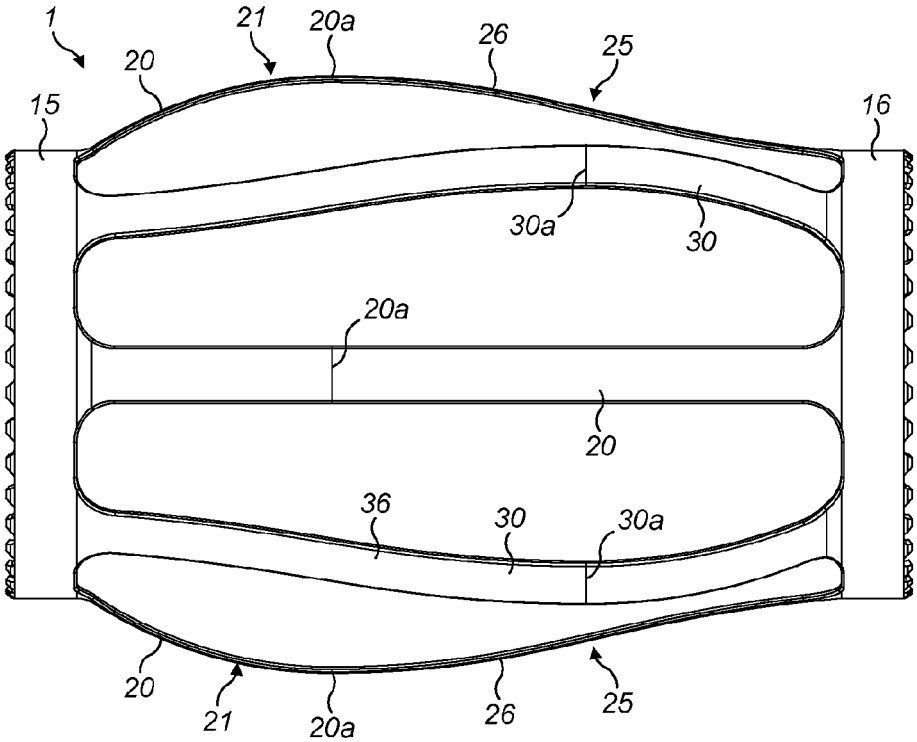

Referring now to the drawings, a centraliser 1 has a body 10 having a central axis, and comprising an upper collar 15, a lower collar 16, and at least one resilient spring extending axially between the collars 15, 16. The central axis passes through the centres of the collars 15, 16, which are arranged perpendicular to the axis. The collars 15, 16 each have a bore arranged coaxially with the axis of the body 1, which receive a tubular T to be centralised within a wellbore of an oil or gas well. The wellbore is typically lined with tubular casing or liner C, having a larger internal diameter than the tubular T, although in some examples the casing C is optional. The centraliser 1 is disposed on the outer surface of the tubular T, and in use occupies the annulus between the outer surface of the tubular T and the inner surface of the casing or liner C. In practice, the centraliser 1 is secured onto the outer surface of the tubular T in a relatively fixed axial position by attaching a stop collar 2 onto the outer surface of the tubular T to limit the axial freedom of movement of the centraliser 1 along the tubular T. Once the stop collar 2 and the centraliser 1 are fixed onto the tubular T, the assembly of the tubular T with the centraliser 1 attached is pushed into the bore of the casing or liner C, thereby compressing the resilient springs within the annulus between the tubular T and the casing C as the centraliser body 10 moves into the bore of the casing C. The body of the centraliser 1 is optionally urged axially into the bore of the casing C by the stop collar 2 which is fixed to the tubular T. The stop collar 2 can be internal or external to the body 10, and can therefore drag one end of the body, or push the other into the casing C. Typically, centralisers 1 are spaced axially along the tubular T at regular intervals in order to maintain the stand-off within the annulus.

In the example shown in FIGS. 1-7, the stop collar 2 can be an internal stop collar, disposed between the two end collars 15, 16 of the centraliser. In this case, the ends of the collars 15, 16 have an inwardly radially extending lip, substantially as disclosed in our previous application WO2012/095671 (which is incorporated herein by reference). The lip can typically be formed by swaging or bending or folding the material of the body radially inwards, and which can hold an end ring in a similar manner to that disclosed in WO2012/095671.

In the present example, the springs take the form of a first set of springs 20 and a second set springs 30. In each set, the springs 20, 30 extend in an axial direction between the upper collar 15 and the lower collar 16. The springs 20, 30 optionally diverge radially outward from the axis of the body 1. The first set of springs 20 are arranged in a set of four springs 20 spaced regularly at 90° intervals around the circumference of the collars. The second set of springs 30 are also arranged in a set of four springs 30 spaced regularly at 90° intervals around the circumference of the collars, but at alternating positions on the circumference of the collars in between adjacent springs 20 of the first set. Accordingly, the springs 20, 30 alternate in sequence around the circumference of the body 1. Thus each spring 20 is spaced at 45° intervals from a spring 30 and vice versa.

The springs 20 have a first portion 21 and a second portion 25. The first portion 21 is axially spaced from the second portion 25 along the axis of the body 1. The first portion 21 is nearest to the upper collar 15, and the second portion 25 is nearest to the lower collar 16. In this example, the axial length of the first portion 21 is substantially similar to the axial length of the second portion 25. The first portion 21 is arranged in a convex arc, optionally having a relatively constant radius, which extends radially outward from the body 1 and reaches a local maximum at an apex 20*a*, at which the distance between the convex arc and the axis of the body 1 is ata maximum. The apex 20*a* is closer to the upper collar 15 than to the lower collar 16, and is located at approximately the midpoint of the first portion 21. The upper end of the first portion 21 extends at an angle of approximately 40° from the upper collar 15. The lower end of the first portion 21 transitions into the second portion 25 at a transition point 26.

The second portion 25 is arranged in a concave arc which is inverted in relation to the arc of the first portion 21. It is not necessary for the first portion to be convex and the second portion to be concave, but it is sufficient for the arcs of the two portions to be inverted with respect to one another. At the transition point 26, the curvature of the first portion reverses, so that below the transition point 26, the second portion describes a concave arc, which is optionally of relatively constant radius. At the transition point, the path taken by the resting spring 20 changes and begins to diverge away from the axis of the body 1. The lower end of the convex arc on the second portion 25 extends into the lower collar 16 at an angle of approximately 5°.

Accordingly, the first and second portions 21, 25 are arranged in inverse arcs relative to one another. The second portion 25 is disposed radially closer to the axis of the body 1 than the first portion 21, in the resting configuration of the centraliser. However, both the first portion 21 and the second portion 25 are spaced radially outwards from the collars 15, 16. The spring 20 is asymmetric along the axis of the body 1.

The springs 30 are essentially a mirror image of the springs 20, and have a first portion 31 and a second portion 35. The first portion 31 is axially spaced from the second portion 35 along the axis of the body 1. However, the springs 30 are inverted around the midline of the centraliser with respect to the springs 20. The first portion 31 is nearest to the lower collar 16, and the second portion 35 is nearest to the upper collar 15. The axial lengths of the first and second portions are substantially similar. The first portion 31 is arranged in a convex arc having an apex 30*a*, which is closer to the lower collar 16 than to the upper collar 15, and is located at approximately the midpoint of the first portion 31. The lower end of the first portion 31 extends at an angle from the lower collar 16. The upper end of the first portion 31 transitions into the second portion 35 at a transition point 36.

The second portion 35 above the first portion 31 is arranged in a concave arc which is inverted in relation to the arc of the first portion 31. At the transition point 36, the curvature of the first portion reverses, and the path taken by the resting spring 30 begins to diverge away from the axis of the body 1 in a concave arc. The upper end of the second portion 35 extends into the upper collar 15 at an angle.

Accordingly, the first and second portions 31, 35 are arranged in inverse arcs relative to one another. The second portion 35 is disposed radially closer to the axis of the body 1 than the first portion 31, in the resting configuration of the centraliser. However, both the first portion 31 and the second portion 35 extend radially outwards from the collars 15, 16. Accordingly, the spring 30 is asymmetric along the axis of the body 1.

As can be seen from the above, the apex 20*a* of the springs 20 is closer to the upper collar 15 than to the lower collar 16, whereas the reverse applies with respect to the springs 30, in which the apex 30*a* is closer to the lower collar 16 than to the upper collar 15. Accordingly, the local maxima of the springs 20 are spaced along the axis of the centraliser with respect to the local maxima of the springs 30.

Optionally all of the springs 20 have the same configuration as one another. Likewise, all of the springs 30 optionally have the same configuration as one another. Thus, the apexes 20*a* on each of the springs 20 are optionally aligned at the same point on the axis of the centraliser. Likewise, the apexes 30*a* on each of the springs 30 are aligned at the same point on the axis of the centraliser, and are spaced axially along the body 1 in relation to the apex 20*a*.

Figure 9:
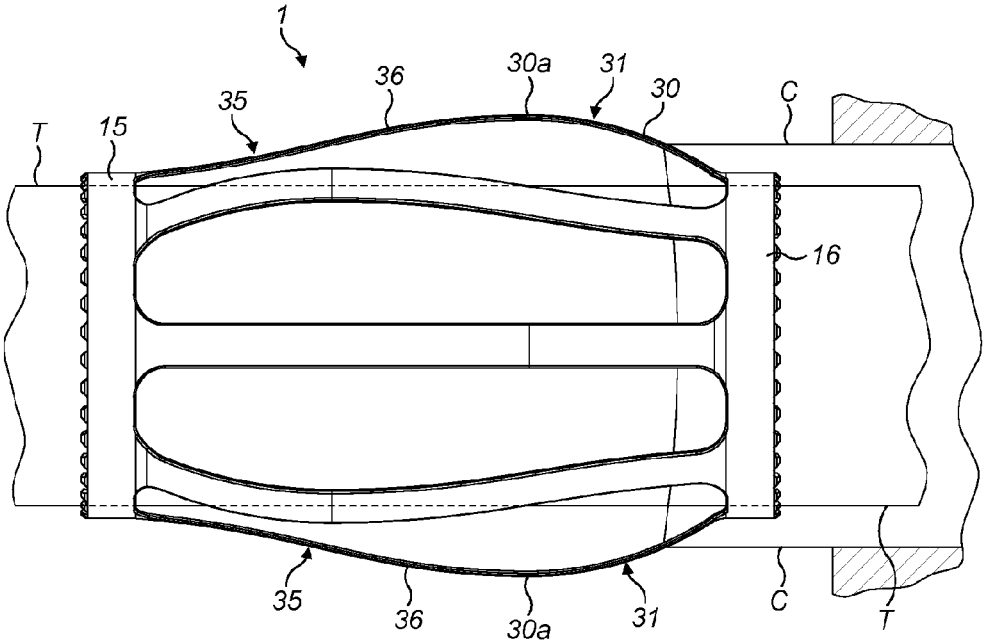
FIGS. 9 and 10 show sequential views of the centraliser of FIG. 1 in place on a tubular T and being inserted into a length of casing C.
Figure 10:
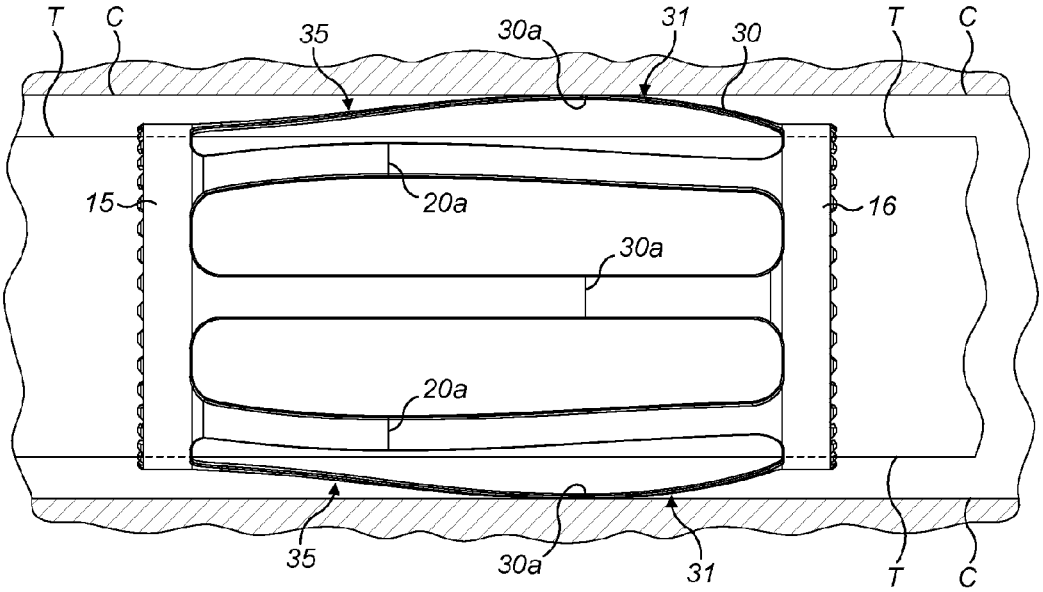

Because the apexes 20*a* and 30*a* on the springs 20 and 30 are axially offset from one another along the axis of the body 1, the apex 30*a* on the lower second set of springs 30 is arranged to enter a bore of the casing C before the apex 20*a* on the upper first set of springs 20, as the tubular T is pushed into the casing C, as shown in FIGS. 9 and 10. This is advantageous, because initial insertion of the centraliser 1 into the bore of the casing C only requires sufficient axial force on the tubular to radially compress the lower springs 30, and upon the initial insertion, the upper springs 20 remain outside the bore of the casing C and need not be compressed.

Once the lower springs 30 have been radially compressed into the bore of the casing C, the axial reaction force applied by the lower springs against the insertion force applied to the tubular T is relatively small. Therefore, axially offsetting the apexes of the springs 20 from the springs 30 is very useful as it reduces the axial force required to feed the tubular into the bore of the casing. As the axial movement of the tubular T into the bore of the casing C continues, the upper springs 20 engage the upper end of the casing C, and are as a result compressed radially in order to fit into the bore. The force required to radially compress the upper springs 20 is not substantially more than that required to compress the lower springs 30, because once compressed, all of the springs inside the bore of the casing C generate relatively little resistance to axial movement. Hence the overall force required to insert the string into the casing is lowered. This is exceptionally useful, because it enables the construction of centralisers with stronger springs, which are less radially compressible, and which therefore perform better in deviated wells by applying more radial force to the tubular in order to maintain the stand-off in deviated sections. In addition, the radial spacing of the annulus required to accommodate the centraliser can be reduced because of the stronger springs, which allows the use of a larger diameter tubular within the casing thereby increasing the size of the conduit for recovery of fluids from the well, or for delivery of fluids into the well for other reasons.

When the resilient devices 20, 30 are radially compressed by the axial insertion of the centraliser 1 into the bore of the casing C, the first and second portions deform in relation to one another in an advantageous manner. This will now be described in relation to the second springs 30, but the principle is the same in relation to the first springs 20, which are optionally mirror image arrangements of the second springs 30.

When the upper surface of the bore of the casing C engages the outer surface of the lower springs 30 as best shown in FIG. 9, it initially does so on a rising part of the first portion 31 below the apex 30*a*, i.e. in which the radial distance from the axis is increasing with the axial distance. Note that in FIG. 9 the stop collar has been omitted for clarity, but is typically located between the collars 15, 16. The first portion 31 curves outwards from the axis of the centraliser 1 in a convex arc. The apex 30*a* of the first portion 31 is radially spaced further away from the axis of the centraliser 1 than the rising part of the first portion 31 below the apex 30*a* which initially engages the edge on the opening of the bore of the casing C, so axial insertion of the centraliser 1 into the bore of the casing C causes the edge of the casing C to ride up the rising part of the first portion 31, which causes the first portion 31 to compress radially inwards towards the axis of the centraliser 1 until the upper surface of the bore of the casing C reaches the apex 30*a*, at which point the spring has been compressed to its minimum diameter as shown in FIG. 10.

Because the convex arc on the first portion 31 is linked to the concave arc on the second portion 35 through the transition point 36, the radial inward deformation of the first portion 31 towards the axis of the centraliser also causes deformation of the second portion 35 with the concave arc. As the first portion 31 deforms radially inwards, the distal end of the first portion furthest away from the collar and closest to the transition point 36 transfers the deformation force to the second portion 35 and which reacts by deforming radially outwards, away from the axis of the centraliser 1. In the deformed configuration caused by radially inward urging of the apex 30*a* of the spring 30, the convex and concave arcs in the first and second portions 31, 35 both reduce in curvature, and the resilient device adopts a generally flatter configuration within the annulus. In the deformed configuration, the spring 30 as a whole is still biased radially away from the outer surface of the tubular T being centralised, which is typically only engaged by the inner surfaces of the end collars 15, 16. However, the radially outer surface of the deformed spring 30 engages the inner surface of the casing C over a larger surface area as a result of the cancellation of the arcs on the first and second portions 31, 35, which presses a flatter surface of the deformed spring 30 against the inner surface of the casing C over a larger surface area. This can usefully serve to resist movement of the centraliser 1 in rotation relative to the casing C, but usefully does not substantially resist axial movement. Accordingly, the centraliser 1 is generally more resistant to rotation relative to the casing C, and optionally when the tubular T is rotated within the bore of the centraliser 1, the centraliser 1 remains rotationally static relative to the casing C, while the tubular T rotates within the bore of the centraliser 1 (optionally within the bores of the collars 15, 16).

As shown in FIG. 9, when the tubular T is entering the bore of a length of casing C, the centraliser 1 does not deform until the lower springs 30 encounter the edge of the casing C and at that point the centraliser 1 is in the resting configuration. Accordingly the apexes 20*a* and 30*a* are at their maximum radial deflection, having a greater diameter than the inner diameter of the casing C. As the tubular T advances axially into the bore of the casing C, the upper edge of the casing C engages the rising parts of the first portions 31 of the lower spring 30 set, below the apex 30*a*. As axial insertion of the tubular T continues, the edge of the casing C rides up the rising part of the first portion 31 towards the apex 30*a*, deforming the set of springs 30 radially inwards. As the springs 30 deform, the curvature of the arc in the first portion 31 decreases as the first portions 35 of the springs 30 move radially inwards. The deformation force encountered by the arcs in the first portions 31 is transmitted to the second portions 35 above the apex 30*a*. The transition point 36 remains relatively axially static relative to the body 1 as the second portion 31 deforms above it.

This radial inward movement of the first portion 31 and its connection to the second portion 35 at the transition point 36 transmits the deformation force through the transition point 36, and causes consequential deformation of the second portion 35 above the transition point 36 on the lower springs 30. The arcs on the first portion 31 and the second portion 36 both reduce in curvature which generally flattens the whole of the spring 30 and maintains it in a generally more planar configuration that is generally aligned with the inner surface of the casing C as best shown in FIG. 10.

It is particularly advantageous that the arcs on the first and second portions 31, 35 deform in a cooperative manner to radially compress one of the arcs while radially expanding the other, and reducing the curvature on each of the arcs, because this flattens the spring and maintains substantially all of the parts of the springs away from the outer surface of the tubular. This reduces the risk of parts of the springs being crushed against the tubular and enhances the freedom of the tubular being centralised to rotate within the centraliser, because typically the only parts of the centraliser 1 to contact the outer surface of the tubular T are the inner surfaces of the end collars 15, 16 engaging the outer surface of the tubular T, and the springs can be deformed without engaging the tubular. These inner surfaces of the collars 15, 16 can be adapted as bearings, and can be polished and/or may optionally incorporate low friction materials or facings, which therefore engage the tubular T with a relatively low friction surface, thereby enhancing the freedom of movement of the tubular T within the bore of the collars 15, 16, and allowing free rotation if required in order to assist insertion and deployment into the casing C. The outer surfaces of the springs 30 which are pressed against the inner surface of the casing C in the deformed configuration optionally have increased resistance to rotational movement of the centraliser 1 relative to the casing C, and so the tubular T being centralised within the bore of the centraliser 1 can optionally be freely rotated during insertion of the string into the casing C, while the centraliser 1 remains rotationally static relative to the outer casing C. In addition to lowering the torque experienced by the tubular T being centralised, this feature has the additional benefit that the outer surface of the tubular T being centralised is only engaged by the smooth inner bearing surface of the collars, which reduces damage to the outer surface of the tubular T, and also reduces damage and wear to the springs themselves, during rotation of the tubular T within the centraliser 1. Since the centraliser 1 has enhanced resistance to rotational movement relative to the casing C in the deformed configuration, the risk of scoring or otherwise damaging the inner surface of the casing as a result of free rotation of the centraliser 1 with the string during insertion into the casing is also reduced.

Figure 8:
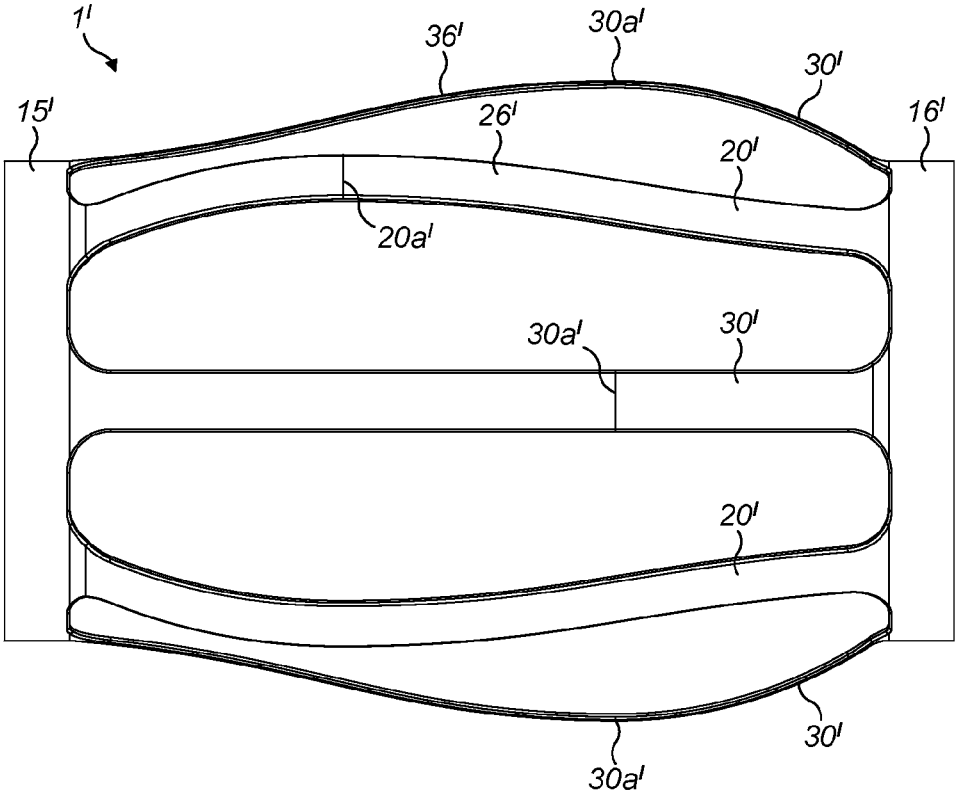
FIG. 8 shows a side view similar to FIG. 4 of a different centraliser.

Referring now to FIG. 8, a second design of centraliser 1' is generally similar to the centraliser 1 described above, and has end rings 15', 16', springs 20', 30' with apexes 20'*a*, 30'*a*, and transition points 26', 36'. The centraliser 1' is in most respects similar to the centraliser 1 described above. The main difference between the centraliser 1' and the centraliser 1 is that the centraliser 1' does not have a lip retaining an end ring in each of the collars 15', 16' and is instead intended for use with external stop locks, located on the tubular on either side of the centraliser 1', or is otherwise secured on a tubular T by other means, for example by being axially restrained between shoulders on the tubular T, for example at connections between adjacent lengths of tubular, or on subs having external shoulders on the tubular. Otherwise, the structure and function of the centraliser 1' is essentially the same as that described in relation to the above centraliser 1, which will not be repeated here for brevity, but to which the reader is referred in relation to further details relating to the structure and function of the centraliser 1'.

The invention claimed is:

1. A centraliser having a central axis, and having first and second axially spaced collars and first and second sets of resilient devices extending between the collars, the collars having bores which are coaxial with the central axis, for receiving a tubular to be centralised, wherein the resilient devices in each set are spaced around the circumference of the collars, each of the resilient devices comprising a first arc and a second arc, wherein the first arc is connected to the second arc at a transition point spaced axially between the first and second collars, wherein the curvature between the first and second arcs reverses at the transition point between them, such that the curvature of the second arc in relation to the central axis is inverted with respect to the curvature of the first arc in relation to the central axis, and wherein each resilient device is asymmetric along the central axis, wherein in each resilient device in the first set, the first arc extends from the first collar and the second arc extends from the second collar, and in each resilient device of the second set, the first arc extends from the second collar, and the second arc extends from the first collar.

2. The centraliser as claimed in claim 1, wherein each first arc in each set has an apex which is spaced radially away from the axis of the centraliser, the apex defining the maximum radial distance between the resilient device and the axis of the centraliser, and wherein the apex in the first set of resilient devices is axially offset with respect to the apex in the second set of resilient devices.

3. The centraliser as claimed in claim 1, wherein the first arc is convex and the second arc is concave.

4. The centraliser as claimed in claim 1, wherein the resilient device has a first portion and a second portion wherein the first portion of the resilient device is set in the first arc, and the second portion of the resilient device is set in the second arc.

5. The centraliser as claimed in claim 1, wherein the first arc and the second arc are each spaced radially outwardly from the collars.

6. The centraliser as claimed in claim 1, wherein the transition point between the first and second arcs is disposed at or near the midpoint between the first and second collars.

7. The centraliser as claimed in claim 1, wherein the first arc has an apex which defines the maximum radial distance between the first arc and the axis of the centraliser in the resting configuration of the centraliser.

8. The centraliser as claimed in claim 7, wherein the second arc is disposed between the apex of the first arc and the axis of the centraliser.

9. The centraliser as claimed in claim 7, wherein the second arc is disposed between the apex of the first arc and one of the collars.

10. The centraliser as claimed in claim 7, wherein the second arc has an apex and wherein the apex of the second arc is axially spaced from the apex of the first arc.

11. The centraliser as claimed in claim 1, wherein the second arc is axially offset in relation to the first arc.

12. The centraliser as claimed in claim 1, wherein the first arc and the second arc each have an axial length, and wherein the axial length of the first arc is equal to the axial length of the second arc.

13. The centraliser as claimed in claim 1, wherein the first and second arcs are inverted with respect to one another in the resting configuration of the resilient device, in the absence of forces urging it into a different configuration.

14. The centraliser as claimed in claim 7, wherein in the resting configuration, the apex of the first arc is closer to one collar than to the other.

15. The centraliser as claimed in claim 1, wherein the resilient devices are spaced equidistantly around the circumference of the collars.

16. The centraliser as claimed in claim 1, wherein the resilient devices in each set have the same configuration, with the first arc closer to one of the collars, and the second arc closer to the other of the collars.

17. The centraliser as claimed in claim 1, wherein at least two resilient devices in the same set each have an apex at the same axial position on the centraliser.

18. The centraliser as claimed in claim 1, wherein the apex of each resilient device is axially spaced from the apex of each of its immediate neighbouring resilient devices.

19. The centraliser as claimed in claim 18, wherein the apexes on at least two of the resilient devices are axially offset in relation to the apexes of at least two other resilient devices on the centraliser.

20. The centraliser as claimed in claim 1 wherein the first arc is convex and the second arc is concave and wherein when the resilient device is radially compressed by the insertion of the centraliser into a wellbore, the first and second arcs deform so that the first arc deforms radially inward towards the axis of the centraliser, and the second arc deforms radially outward, away from the axis of the centraliser.

21. The centraliser as claimed in claim 1, wherein when each resilient device is radially compressed by the insertion of the centraliser into a wellbore, the curvature of the first and second arcs reduces.

22. The centraliser as claimed in claim 21, wherein in the deformed configuration caused by radially inward urging of the apex of the resilient device, the first and second arcs move in radially opposing directions towards one another.

23. The centraliser as claimed in claim 20, wherein in the deformed configuration, the resilient device is biased radially away from the outer surface of the tubular being centralised.

24. A method of centralising a tubular within a wellbore, the method including inserting the tubular into an axial bore of a centraliser, the centraliser having a central axis, and having first and second axially spaced collars and first and second sets of resilient devices extending between the collars, the collars having bores which are coaxial with the central axis, for receiving a tubular to be centralised, wherein the resilient devices in each set are spaced around the circumference of the collars, each of the resilient devices comprising a first arc and a second arc, wherein the first arc is connected to the second arc at a transition point spaced axially between the first and second collars, wherein the curvature between the first and second arcs reverses at the transition point between them, such that the curvature of the second arc in relation to the central axis is inverted with respect to the curvature of the first arc in relation to the central axis, and wherein each resilient device is asymmetric along the central axis, wherein in each resilient device in the first set, the first arc extends from the first collar and the second arc extends from the second collar, and in each resilient device of the second set, the first arc extends from the second collar, and the second arc extends from the first collar, and wherein the method includes inserting the centraliser and the tubular into the wellbore, and deforming the first and second arcs when the resilient device is radially compressed by the insertion of the centraliser into a wellbore, and wherein the method includes deforming the first arc radially inward towards the axis of the centraliser, and deforming the second arc radially outward, away from the axis of the centraliser.

25. The method as claimed in claim 24, wherein when the resilient device is radially compressed by the insertion of the centraliser into the wellbore, the curvature of the first and second arcs reduce.

26. The method as claimed in claim 24, wherein in the step of deforming the first arc radially inward towards the axis of the centraliser, and deforming the second arc radially outward, away from the axis of the centraliser, the first and second arcs move in radially opposing directions towards one another.

27. The method as claimed in claim 24, wherein in the step of deforming the first arc radially inward towards the axis of the centraliser, and deforming the second arc radially outward, away from the axis of the centraliser, the first and second arcs are each biased radially away from the outer surface of the tubular being centralised.

28. The method as claimed in claim 24, wherein in the step of deforming the first arc radially inward towards the axis of the centraliser, and deforming the second arc radially outward, away from the axis of the centraliser, the first and second arcs do not engage the tubular.

29. A centraliser having a central axis, and having first and second axially spaced collars and first and second sets of resilient devices extending between the collars, the collars having bores which are coaxial with the central axis, for receiving a tubular to be centralised, wherein the resilient devices in each set are spaced around the circumference of the collars, each of the resilient devices comprising a first arc and a second arc, wherein the curvature of the second arc is inverted with respect to the curvature of the first arc, and wherein each resilient device is asymmetric along the central axis, wherein in each resilient device in the first set, the first arc extends radially outward from the first collar at an angle and the second arc extends radially outward from the second collar at an angle, and in each resilient device of the second set, the first arc extends radially outward from the second collar at an angle, and the second arc extends radially outward from the first collar at an angle.

30. The centraliser as claimed in claim 29, wherein the first arc is connected to the second arc at a transition point spaced axially between the first and second collars, and wherein the curvature between the first and second arcs reverses at the transition point between the first and second arcs.

* * * * *